US005568374A

United States Patent [19]

Lindeboom et al.

[11] Patent Number: 5,568,374

[45] Date of Patent: Oct. 22, 1996

[54] VACUUM CLEANER WITH THREE-WIRE POWER-SUPPLY AND COMMUNICATION CONNECTION BETWEEN FUNCTIONAL UNITS TO BE COUPLED

[75] Inventors: Wieger Lindeboom; Jan Tiesinga; Peter S. Viet, all of Drachten, Netherlands

[73] Assignee: U.S. Philips Corporation, New York, N.Y.

[21] Appl. No.: 338,934

[22] Filed: Nov. 14, 1994

[30] Foreign Application Priority Data

Nov. 10, 1993 [BE] Belgium ..... 09301244

[51] Int. Cl.[6] ..... G06F 19/00; A47L 9/28

[52] U.S. Cl. ..... 364/131; 15/319

[58] Field of Search ..... 364/131, 132, 364/133; 15/319, 339

[56] References Cited

U.S. PATENT DOCUMENTS 4,455,652 6/1984 van der Meulen ..... 364/184

4,654,924 4/1987 Getz et al. ..... 15/319

4,953,253 9/1990 Fukuda et al. ..... 15/319

5,265,305 11/1993 Kraft et al. ..... 15/319

5,353,468 10/1994 Yap et al. ..... 15/319

*Primary Examiner*—Paul P. Gordon

*Attorney, Agent, or Firm*—Ernestine C. Bartlett

[57] ABSTRACT

A vacuum cleaner is provided which has a motor housing (2) and a hose (8), which can be coupled via two mains-voltage wires (38, 42), one communication wire (48) and contacts (32, 34, 30). The motor housing (2) and the handle (10) of the hose (8) include microprocessors (6, 12) which communicate with one another via the communication wire (48). The first reference signal (26) of the one microprocessor (6) is connected to the one mains voltage terminal (18) and the second reference signal (44) of the other microprocessor (12) is connected to the other mains voltage terminal (40).

12 Claims, 6 Drawing Sheets

VACUUM CLEANER WITH THREE-WIRE POWER-SUPPLY AND COMMUNICATION CONNECTION BETWEEN FUNCTIONAL UNITS TO BE COUPLED

FIELD OF THE INVENTION

The invention relates to a vacuum cleaner comprising: a first functional unit, and a second functional unit which can be coupled electrically to the first functional unit; which first functional unit comprises a first mains voltage terminal and a second mains voltage terminal for receiving an alternating mains voltage, and a first data processing unit having a first reference terminal and a first communication terminal; which second functional unit comprises a first mains voltage terminal and a second mains voltage terminal for receiving the alternating mains voltage, and a second data processing unit having a second reference terminal and a second communication terminal; which first mains voltage terminal of the first functional unit can be coupled to the first mains voltage terminal of the second functional unit via a first mains voltage wire and a first mains voltage contact; which second mains voltage terminal of the first functional unit can be coupled to the second mains voltage terminal of the second functional unit via a second mains voltage wire and a second mains voltage contact; and which first communication terminal can be coupled to the second communication terminal via a communication wire and a communication contact.

BACKGROUND OF THE INVENTION

Such a vacuum cleaner ms known from U.S. Pat. No. 4,654,924. This known vacuum cleaner comprises three functional units, i.e. a motor housing, a hose with a handle and a suction nozzle. The controls are arranged on the handle, which for this purpose includes control buttons for activating various functions of the vacuum cleaner. The handle further includes an indicator device or display screen to give various indications about the operating condition of the vacuum cleaner. For a correct operation of the system the motor housing and the handle include data processing units which should be capable of communicating with one another. A suction nozzle can be attached to the hose, which nozzle comprises a rotating brush driven by an electric motor which is powered by the alternating mains voltage. The suction nozzle also accommodates a data processing unit which communicates with the data processing unit in the handle. In order to provide data communication between the handle, the motor housing and the suction nozzle and to supply mains voltage to the electric motor of the brush the functional units can be coupled by means of three wires. Therefore, the hose is provided with three wires, a first and a second mains voltage wire for mains voltage supply and a communication wire for the data communication, which three wires are connected to the motor housing via contacts. The data processing units in the motor housing and in the handle receive a direct voltage supply from rectifier circuits, which locally convert the alternating mains voltage into a suitable direct voltage. A similar three-wire connection is present between the hose and the suction nozzle.

In the known vacuum cleaner one of the two mains voltage wires also functions as a return wire for the data signals. This is achieved by connecting the signal earth or reference terminal of the first and the second data processing unit to the same mains voltage terminal. A problem of this arrangement is that current surges in the return wire, produced by the electric motor of the brush or by other causes, may disturb the data communication. This can be remedied by selecting a comparatively high signal level for the data communication. This has the drawback that the microprocessors used for data communication cannot withstand or are not suitable for such high signal levels, which necessitates the use of separate voltage conversion stages with a separate high supply voltage. However, the use of the vacuum cleaner causes a substantial soiling of the contacts coupling the three wires of the functional units to one another. The contacts for the mains voltage are self-cleaning as a result of the high alternating mains voltage in the case of an open or soiled contact. However, the voltage across an open or soiled contact for the communication wire is substantially lower and is approximately 19 V for the known vacuum cleaner. Consequently, the cleaning effect of this voltage, which is comparatively low in relation to the alternating mains voltage, is substantially smaller, so that the risk of the data communication being disturbed by an open or soiled communication contact is substantially greater.

SUMMARY OF THE INVENTION

It is an object of the invention to solve the above problems and to provide a vacuum cleaner of the type defined in the opening paragraph, which in accordance with the invention characterized in that the first reference terminal is connected to the first mains voltage terminal of the first functional unit and the second reference terminal is connected to the second mains voltage terminal of the second functional unit.

By connecting the reference terminals of the first and the second data processing units to the different mains voltage terminals instead of to the same mains voltage terminal, a current will flow from the first mains voltage terminal to the second mains terminal, or vice versa, via the communication contact during data communication. A soiled or open communication contact will now also be self-cleaning owing to the high alternating mains voltage across the first and the second mains voltage terminals.

The three wires are capacitively coupled to one another. The capacitive coupling is considerable especially in the hose as a result of the comparatively great length of the three wires. Variations in the voltage level of the communication wire with respect to the first or the second mains voltage wire therefore occur with a certain time constant, which may corrupt the data communication. In order to minimize this corrupted data communication a first variant of a vacuum cleaner in accordance with the invention is characterized in that the first data processing unit comprises a current source for supplying to the first communication terminal a signal current whose value varies in response to a data signal to be transmitted via the communication wire, and the second data processing unit comprises a current-voltage converter for converting the signal current into a signal voltage, and a level detector for comparing the signal voltage with a reference voltage.

Data communication is effected with a current source at the transmitting side and a current-voltage converter at the receiving side. The instantaneous voltage on the communication wire then does not play a part in the data transmission because the current source automatically adapts itself to the voltage on the communication wire. The data transmission is now based on a data signal current instead of a data signal voltage. A further advantage thus obtained is that the input impedance at the receiving side can be reduced by a suitable construction of the current-voltage converter. As a result of this, the communication wire is less susceptible to interference and a more robust communication system is obtained. Another advantage is that the amplitude of the current supplied by the current source can simply be fixed at such a value that international interference standards (CISPR standards) are complied with for all the prevailing alternating mains voltages. Yet another advantage is that the fixed current amplitude allows a current detection at a fixed level, so that the receiver does not respond to small interference currents. A further advantage is that only the current source should be capable of handling the mains voltage; the other parts, specifically the current-voltage converter, the level detector and the other circuits in the data processing units can be constructed with low-voltage components.

A second embodiment of a vacuum cleaner is characterised in that the current source comprises: a first transistor having a control electrode connected to receive the data signal, a first main electrode coupled to the first reference terminal via a first resistor, and a second main electrode coupled to the first communication terminal. This embodiment is simple and cheap and requires a small number of parts, as a result of which it is very suitable for use in vacuum cleaners.

A third embodiment of a vacuum cleaner in accordance with the invention is characterised in that the level detector comprises: a second transistor having a control electrode coupled to the second reference terminal, a first main electrode, and a second main electrode coupled to a supply voltage source via a second resistor, and in that the current-voltage converter comprises a third resistor connected between the first main electrode of the second transistor and the second reference terminal. This embodiment is also simple and cheap and requires a small number of parts, so that it is also very suitable for use in vacuum cleaners.

A fourth embodiment of a vacuum cleaner in accordance with the invention is characterised in that the first communication terminal is coupled to the current source via a first diode and the second communication terminal is coupled to the current-voltage converter via a second diode, the forward direction of the first diode and the second diode corresponding to the direction of the signal current from the current source. The diodes enable two-way communication via the communication wire, communication being possible from the first to the second data processing unit in one half-cycle of the mains voltage and in the reverse direction in the other half-cycle. This excludes conflicts as to which of the two data processing units is transmitting.

Another method of data signal transfer is used in a fifth embodiment of a vacuum cleaner in accordance with the invention, which is characterised in that the first data processing unit comprises: a switch connected between the first communication terminal and the first reference terminal, to supply to the first communication terminal a first signal current whose value varies as a result of the switch being turned on and off in response to a first data signal to be transmitted via the communication wire, in that the second data processing unit comprises: a capacitor connected between the second reference terminal and a node, and a first diode which is conductive for the first signal current and which is connected between the node and the second communication terminal, and in that a current-limiting resistor is included in the current path defined by the first communication terminal and the second communication terminal.

In this method the capacitor in the second data processing unit is charged via the first diode and the limiting resistor during switching-over of the switch in the first data processing unit. Thus, a direct voltage is built up across the capacitor simultaneously with the data transfer, which direct voltage can be used as a supply voltage for the electronic devices in the second data processing unit. This enables a separate power supply to be dispensed with, for example in the handle where there is not much room for parts.

According to the invention a sixth embodiment by means of which two-way communication and supply-voltage generation are possible is characterised in that the switch of the first data processing unit comprises: a first transistor of a first conductivity type, having a control electrode connected to receive the data signal, a first main electrode coupled to the first reference terminal, and a second main electrode coupled to the first communication terminal, and in that the second data processing unit comprises: a second transistor of a conductivity type opposite to the first conductivity type, having a first main electrode connected to the second reference terminal, a second main electrode coupled to the bode via a first resistor, and a control electrode coupled to the second reference terminal via a second resistor and to the second communication terminal via a third resistor, and in that the second data processing unit further comprises a third transistor of the first conductivity type, having a control electrode connected to receive a second data signal a first main electrode connected to the node, and a second main electrode connected to the second communication terminal to supply a second signal current, and in that the first data processing unit comprises a second diode arranged in parallel with the first transistor and conducting for the second signal current.

In order to reduce the influence of said capacitive coupling between the three wires a seventh embodiment of a vacuum cleaner in accordance with the invention is characterized in that the limiting resistor is made up of two sub-resistors, one of the sub-resistors being arranged in series with the first communication terminal and being shunted by a third diode which conducts for the second signal current and the other sub-resistor being arranged in series with the second communication terminal and being shunted by a fourth diode which conducts for the first signal current. The diodes across the sub-resistors short-circuit the resistors at the receiving side and create a low impedance as seen from the switch at the transmitting side, which switch will behave as a current source owing to the sub-resistor at the transmitting side not being short-circuited, yielding all the advantages described hereinbefore.

BRIEF DESCRIPTION OF THE DRAWINGS

These and other aspects of the invention will now be described and elucidated with reference to the accompanying drawings, in which.

DETAILED DESCRIPTION OF THE PREFERRED EMBODIMENTS

Figure 1:
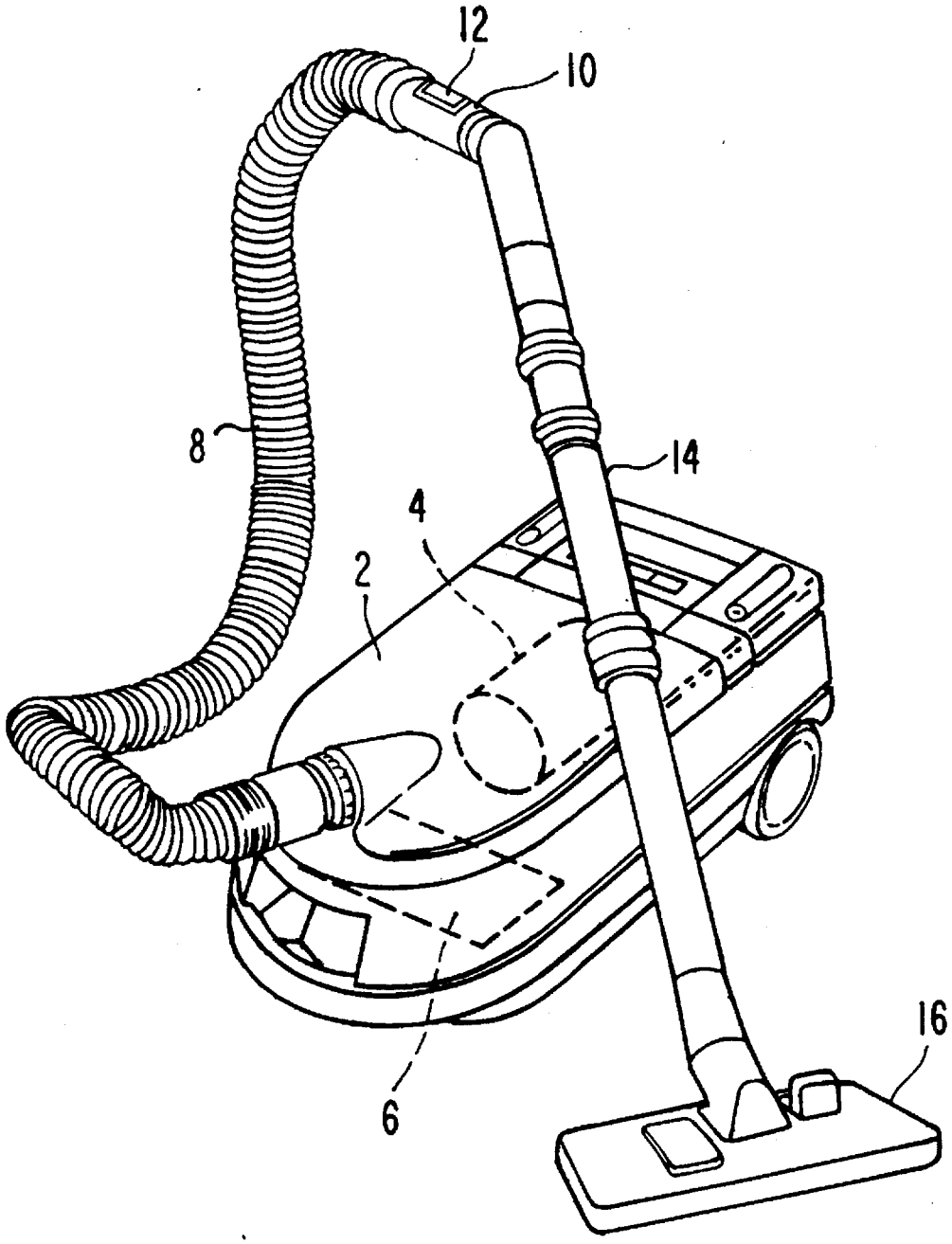
FIG. 1 shows a vacuum cleaner in accordance with the invention.

FIG. 1 shows a vacuum cleaner in accordance with the invention. A first functional unit, in the present case a motor housing 2, accommodates a suction motor 4 and a first data processing unit 6. The motor housing 2 can be coupled to a second functional unit, in the present case a hose 8 provided with a handle 10. The handle 10 accommodates a second data processing unit 12. By means of a tube 14 the hose 8 can be coupled to a third functional unit, in the present case a suction nozzle 16, which if desired may be equipped with a rotary brush driven by a electric motor.

Figure 2:
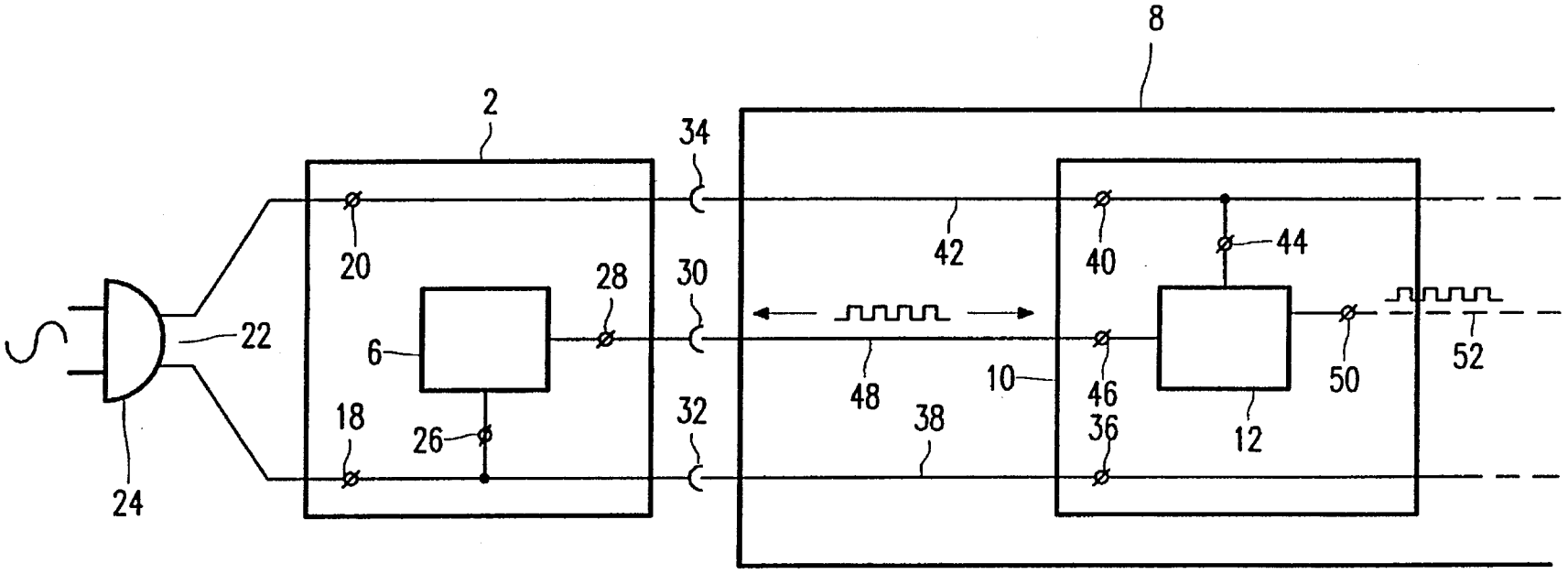
FIG. 2 is an electrical block diagram of a data communication circuit for a vacuum cleaner in accordance with the invention.

FIG. 2 shows the block diagram of the electrical connections between the motor housing 2 and the handle 10. The motor housing 2 receives alternating mains voltage on a first mains voltage terminal 18 and a second mains voltage terminal 20, which can be connected to the a.c. mains via a mains lead 22 and a mains plug 24. The first data processing unit 6 has a first reference terminal 26, which is connoted to the first mains voltage terminal 18, and a first communication terminal 28, which is connected to a communication contact 30. The first mains voltage terminal 18 is connected to a first mains voltage contact 32 and the second mains voltage terminal is connected to a second mains voltage contact 34. The handle 10 has a first mains voltage terminal 36, which is connected to the first mains voltage terminal 18 in the motor housing 2 via a first mains voltage wire 38 and the first mains voltage contact 32. The handle 10 further has a second mains voltage terminal 40 connected to the second mains voltage terminal 20 in the motor housing 2 via a second mains voltage wire 42 and the second mains voltage contact 34. The second data processing unit 12 has a second reference terminal 44, which is connected to the second mains voltage terminal 40, and a second communication terminal 46, which is connected to the communication contact 30 via a communication wire 48. The first mains voltage wire 38, the second mains voltage wire 42 and the communication wire 48 are arranged in the wall of the hose 8 and make electrical contact with the motor housing 2 when the hose 8 is mechanically coupled to the motor housing 2. For this purpose the communication contact 30, the first mains voltage contact 32 and the second mains voltage contact 34 are constructed, for example, as a socket and pin contact or as a slip ring and wiper. The first mains voltage wire 38 and the second mains voltage wire 42 can extend from the handle 10 to the suction nozzle 16 via the tube 14 to supply voltage to the rotary brush. The communication between the handle 10 and the suction nozzle 16 can proceed in the same way as that between the motor housing 2 and the handle 10. To this end the second data processing unit 12 should be provided with a further communication terminal 50, which is coupled to a data processing unit (not shown) in the suction nozzle 16 via a further communication wire 52 in the tube 14.

The data processing units in the motor housing 2, the handle 10 and, if applicable, the suction nozzle 16 permit convenient central control of vacuum cleaner functions from the handled 10 by means of control buttons, which functions may include power control of the motor 4 and switching on/off of the brush motor in the suction nozzle 16. The handle 10 may also include a display screen to indicate the operating condition of the vacuum cleaner, such as the selected motor power, brush motor on/off, dust bag full etc. For a correct operation of the system the motor housing, the handle and, if applicable, the suction nozzle include data processing units which communicate with one another. It is customary to provide the data processing units with programmed microprocessors for a communication with one another in accordance with a communication protocol, which obviously depends on the tasks and functions of the individual functional units.

Figure 3:
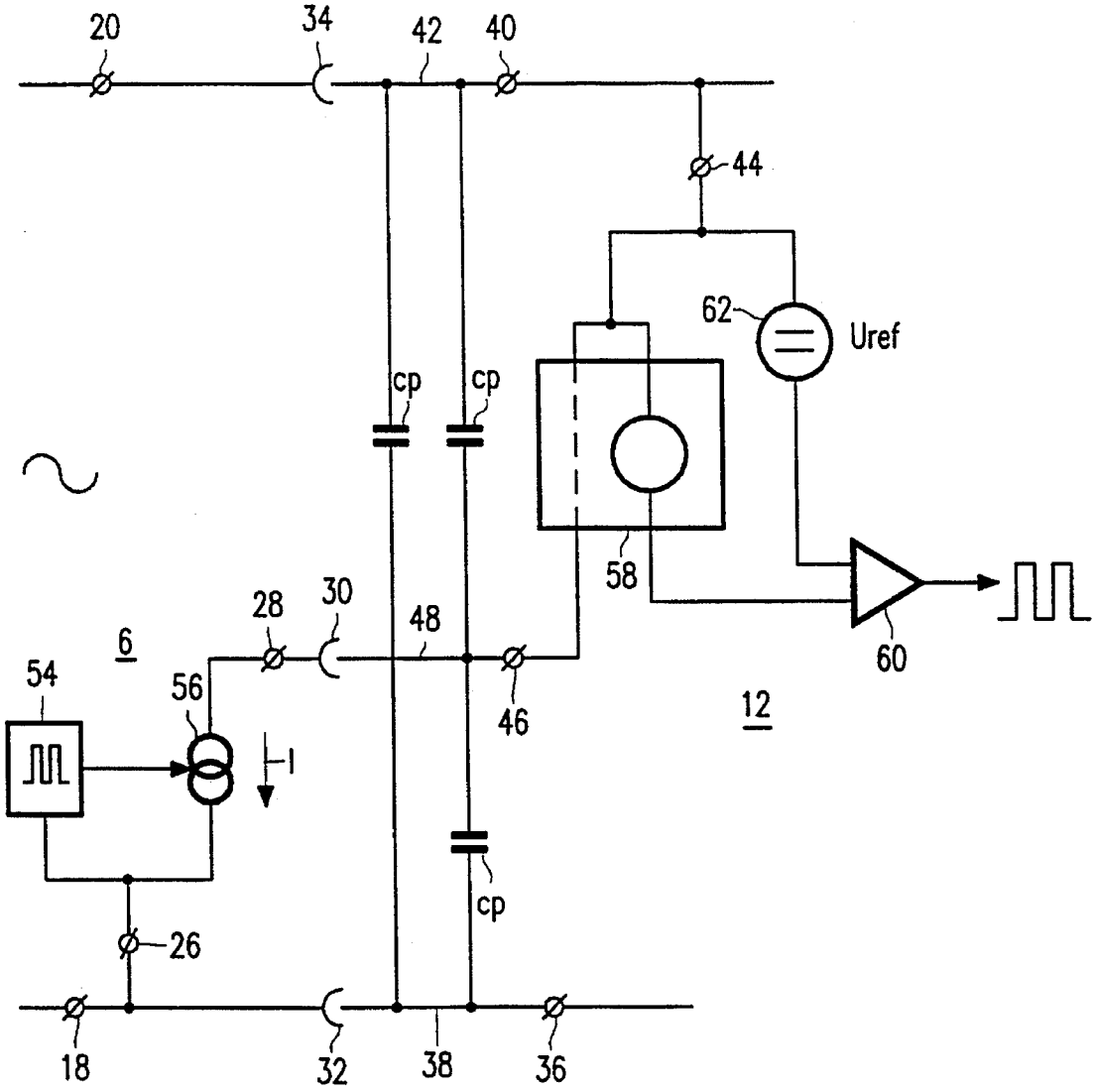
FIG. 3 shows an electrical circuit diagram of a one-way data communication circuit for a vacuum cleaner in accordance with the invention.

FIG. 3 shows a basic circuit diagram corresponding to the block diagram in FIG. 2. The first data processing unit 6 functions as a transmitter and comprises a first microprocessor 54, which controls a current source 56 to convert the voltage pulses of the data signal from the microprocessor 54 into current pulses. The signal earth of the microprocessor 54 and of the current source 56 are both connected to the first reference terminal 26, which in its turn is connected to the first mains voltage terminal 18. The current source 56 is further coupled to the first communication terminal 28 to supply the current pulses. The second data processing unit 12 functions as a receiver and comprises a current-voltage converter 58, a level detector 60 and a reference voltage source 62. The current-voltage converter 58 couples the second communication terminal 46 to the second reference terminal 44 and converts the data signal current, which flows from the second communication terminal 46 to the second reference terminal 44, into a signal voltage whose amplitude is compared with a reference voltage Uref from the reference voltage source 62. The level detector 60 supplies a pulsating output signal, which can be processed further by a microprocessor (not shown). Data communication is based on current pulses of fixed current amplitude. Between the first mains voltage wire 38, the second mains voltage wire 42 and the communication wire 48 parasitic capacitances Cp exist. The parasitic capacitances Cp produce a voltage on the communication wire 48, which voltage is out of phase relative to the voltages on the first mains voltage wire 48 and the second mains voltage wire 42. The output of the current source 56 automatically adapts itself to the instantaneous value of the voltage difference between the communication wire 48 and the first mains voltage wire 38, which precludes corruption of the data signal as a result of charging and discharging of the parasitic capacitances. The current from the current source 56 has a fixed value, which when the current source is designed can simply be adjusted to a value which is in compliance with the relevant interference standards. The level detector 60 and the reference voltage source 62 define a current threshold, so that the receiver does not respond to small spurious currents.

Figure 4:
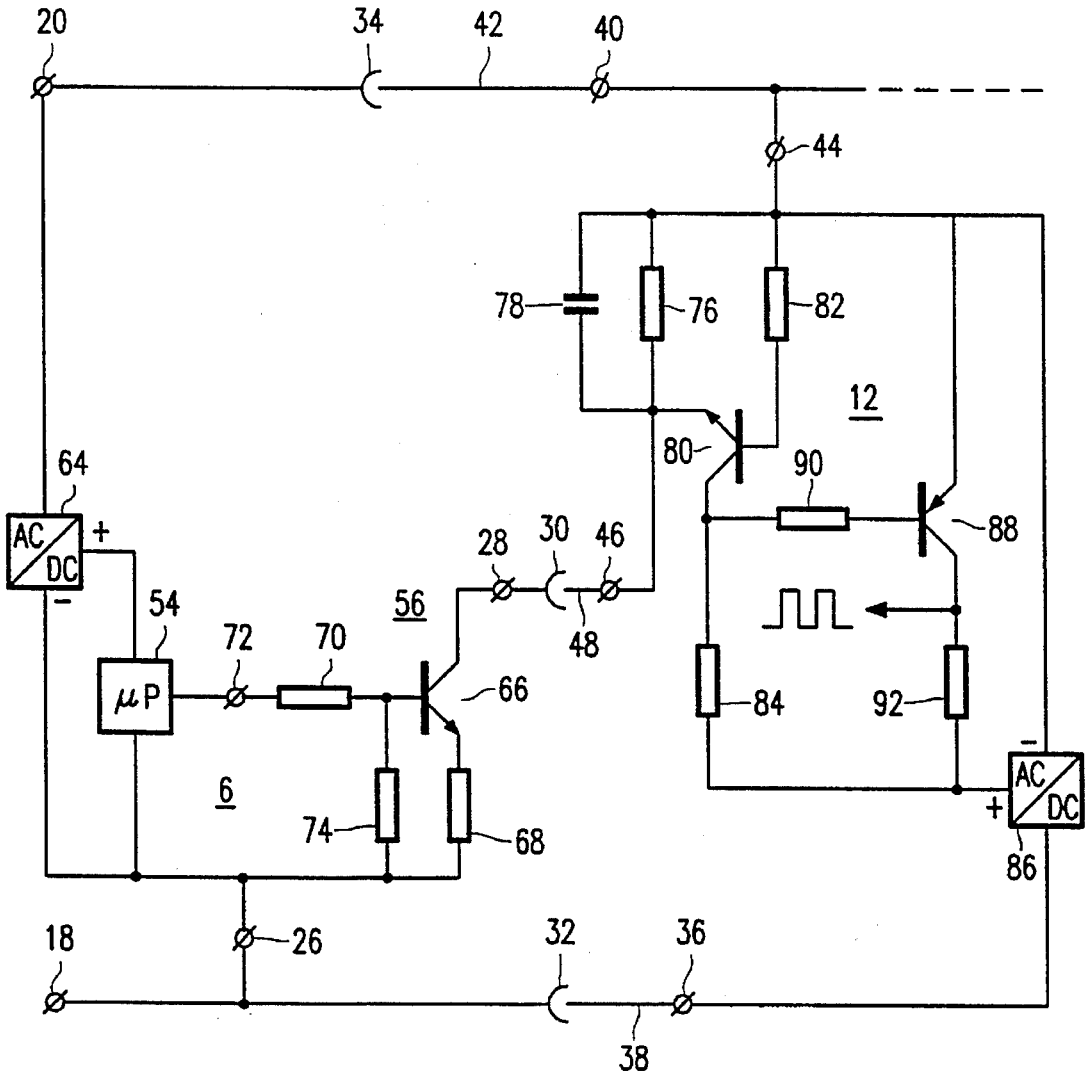
FIG. 4 shows the circuit diagram of FIG. 3 in more detail.

FIG. 4 shows the basic circuit diagram of FIG. 3 in more detail. The microprocessor 54 of the first data processing unit 6 is powered by a first direct voltage supply 64, which converts the alternating mains voltage across the first mains voltage terminal 18 and the second mains voltage terminal 20 into a suitable direct voltage. The current source 56 comprises an npn transistor 66 whose first main electrode or emitter is connected to the first reference terminal 26 via a resistor 68 and whose second main electrode or collector is connected to the first communication terminal 28. The control electrode or base is connected to an output 72 of the microprocessor 54 by a resistor 70 and to the first reference terminal 26 by a resistor 74 to receive the data signal from the microprocessor 54. At the other end of the communication wire 48 a resistor 76 connected between the second communication terminal 46 and the second reference terminal 44 functions as the current-voltage converter. An optional capacitor 78 in parallel with the resistor 76 suppresses high-frequency interference voltages across the resistor 76. An npn transistor 80, whose base is connected to the second reference terminal 44 via a resistor 82 and whose emitter is connected to the second communication terminal 46, simply combines the functions of level detector and reference voltage source. A resistor 84 connects the collector of the npn transistor 80 to a second direct voltage supply 86, which converts the alternating mains voltage across the first mains voltage terminal 36 and the second mains voltage terminal 40 into a direct voltage which is positive relative to the second reference terminal 44. The second mains voltage terminal 20 is positive relative to the first mains voltage terminal 18 during one half-cycle of the mains voltage. If the data signal on the output 72 of the microprocessor 54 is logic high a current, whose magnitude is mainly determined by the resistor 68, will flow from the second mains voltage terminal 40 to the first mains voltage terminal 18 via the resistor 76, the communication wire 48 and the communication contact 30. The voltage drop across the resistor 76 turns on the npn transistor 80. The signal voltage across the resistor 84 is buffered and brought at the desired signal level by means of an npn transistor 88, whose emitter is connected to the second reference terminal 44, whose base is connected to the collector of the npn transistor 80 via a resistor 90, and whose collector is connected to the direct voltage of the second direct voltage supply 86 via a resistor 92. The signal on the collector of the npn transistor 88 can be processed further by a microprocessor, not shown. The circuit arrangement shown enables one-way communication from the first data processing unit 6 to the second data processing unit 12 during one half-cycle of the mains voltage.

Figure 5:
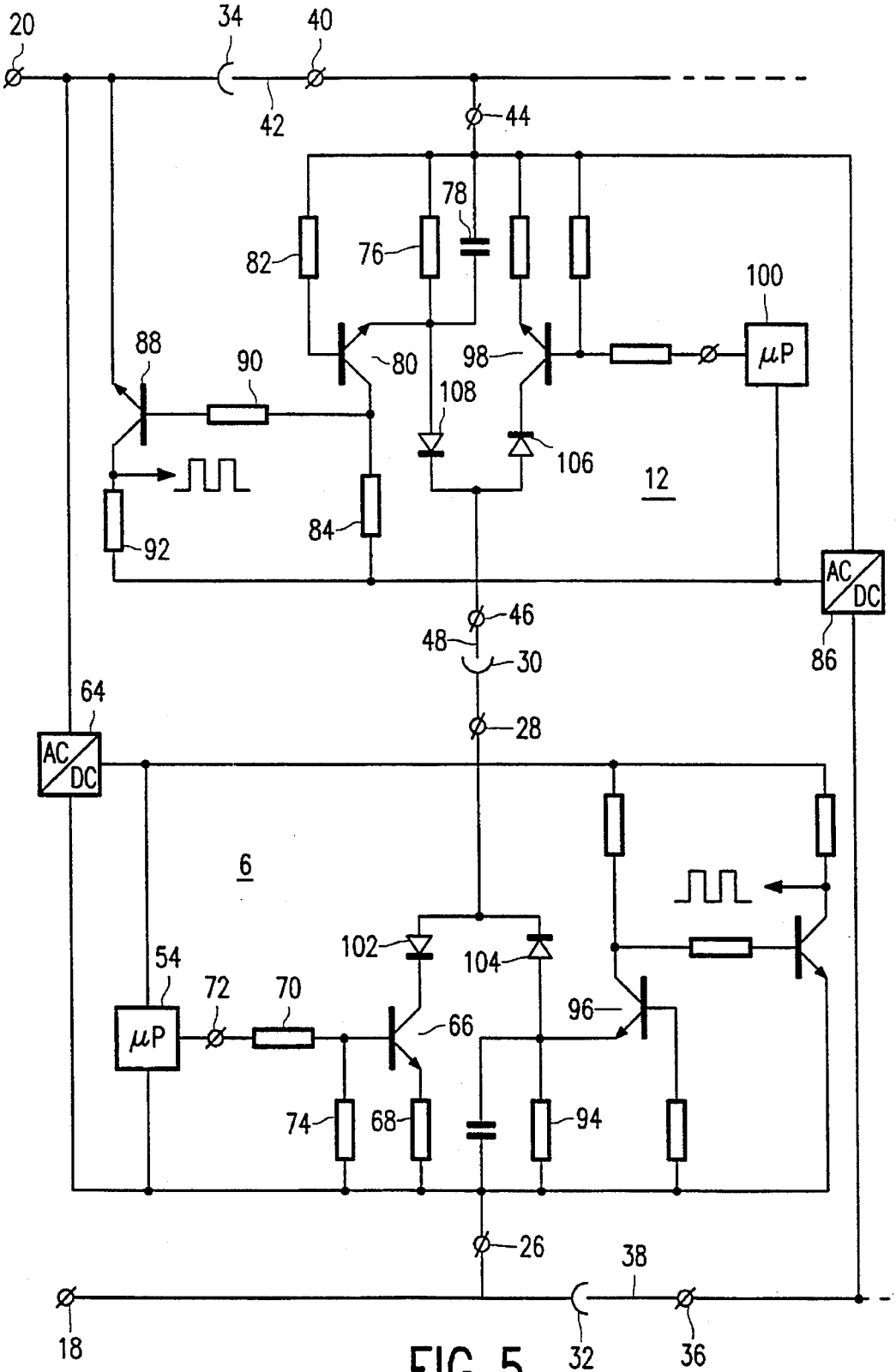
FIG. 5 shows a more detailed circuit diagram of a two-way data communication circuit for a vacuum cleaner in accordance with the invention.

FIG. 5 shows a circuit arrangement which makes it possible to communicate in the opposite direction from the second data processing unit 12 to the first data processing unit 6 during the other half-cycle of the mains voltage. For this purpose the first data processing unit 6 in addition comprises a resistor 94 for current-voltage conversion and a transistor 96 for level detection, arranged similarly to the corresponding elements in the second data processing unit 12 shown in FIG. 4, and the second data processing unit 12 in addition comprises a transistor 98 and a microprocessor 100, arranged similarly to the corresponding elements in the first data processing unit 6. In the first data processing unit 6 a diode 102 is arranged between the first communication terminal 28 and the collector of the npn transistor 66 and is conductive for the collector current of the npn transistor 66, and a diode 104 is arranged between the first communication terminal 28 and the resistor 94 and is conductive for the collector current of the transistor 98. In the second data processing unit a diode 106 is arranged between the second communication terminal 46 and the collector of the transistor 98 and is conductive for the collector current of the transistor 98, and a diode 108 is arranged between the second communication terminal 46 and the resistor 76 and is conductive for the collector current of the npn transistor 66. The diode 104 and the diode 108 prevent the direct flow of current from the first mains voltage terminal 18 to the second mains voltage terminal 40 and vice versa. The diode 102 and the diode 106 prevent an undesired current flow in the collector-base path of the current-source transistor at the receiving side.

Figure 6:
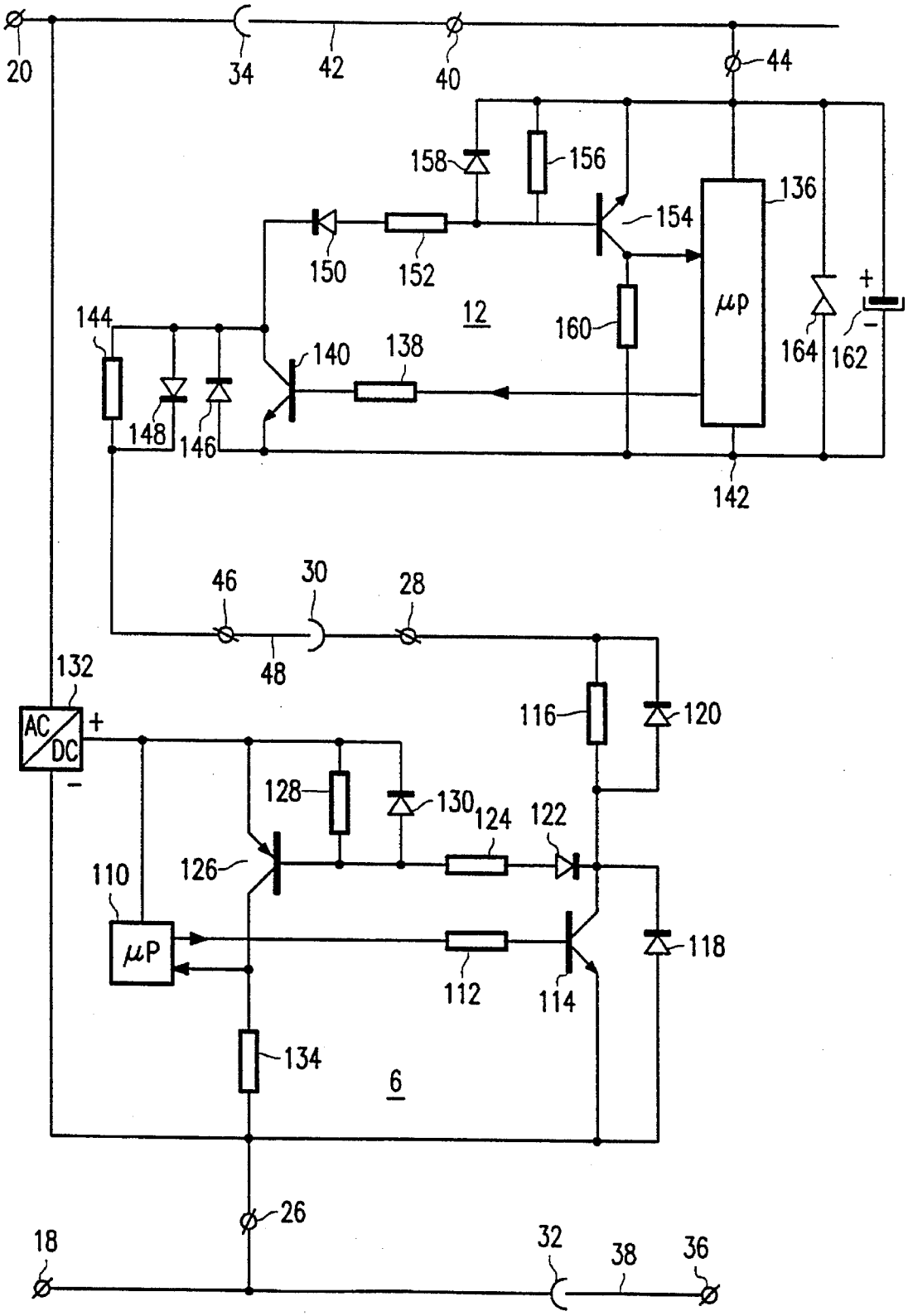
FIG. 6 shows a more detailed circuit diagram of an alternative two-way data communication circuit for a vacuum cleaner in accordance with the invention.

FIG. 6 shows an alternative circuit arrangement which also provides two-way communication. However, a separate direct voltage supply in the second data processing unit 12 can now be dispensed with. The circuit arrangements shown in FIGS. 3, 4 and 5 operate with switched current sources for the data communication. The circuit arrangement in FIG. 6 does not use current sources but it employs switches and series resistors. The first data processing unit 6 comprises a microprocessor 110 which, via a resistor 112, drives the base of a first npn switching transistor 114, whose emitter is connected to the first reference terminal 26 and whose collector is connected to the first communication terminal 28 via a current limiting resistor 116. A diode 118 is arranged in parallel with the first switching transistor 114 and has its cathode connected to the collector of the first npn switching transistor 114, and another diode 120 is arranged in parallel with the current limiting resistor 116 and has its cathode connected to the first communication terminal 28. The diode 118 and the diode 120 are cut off when collector current flows from the first communication terminal 28 to the first reference terminal 26. The collector of the first npn switching transistor 114 is connected to the base of a pnp transistor 126 via a diode 122 and a resistor 124. The base of the pnp transistor 126 is connected to a positive supply voltage via a resistor 128 and a diode 130 in parallel with this resistor, which supply voltage is furnished by a direct voltage supply 132, which also provides the supply voltage for the microprocessor 110 and the emitter of the pnp transistor 126. The collector of the pnp transistor 126 is connected to the first reference terminal 26 via a resistor 134 and to a data signal input of the microprocessor 110.

The second data processing unit 12 comprises a microprocessor 136, which drives the base of a second npn switching transistor 140 via a resistor 138, which transistor has its emitter connected to a node 142 and its collector to the second communication terminal 46 via a current-limiting resistor 144. A diode 146 is arranged in parallel with the second npn switching transistor 140 and has its anode connected to the node 142 and another diode 148 is arranged in parallel with the first npn switching transistor 114 and has its cathode connected to the second communication terminal 46. The diode 146 and the diode 148 are cut off when collector current flows from the second communication terminal 46 to the node 142. The collector of the second npn switching transistor 140 is connected to the base of a pnp transistor 154 via a diode 150 and a resistor 152. The base of the pnp transistor 154 is connected to the second mains voltage terminal 40 via a resistor 156 in parallel with a diode 158, which second mains voltage terminal is also connected to the microprocessor 110 and to the emitter of the pnp transistor 126. The collector of the pnp transistor 154 is connected to the node 142 via a resistor 160 and to a data signal input of the microprocessor 110. The signal earth of the microprocessor 136 is connected to the node 142. A capacitor 162, in parallel with a voltage-limiting zener diode 164, is connected between the second mains voltage terminal 40 and the node 142.

In the half-cycle of the mains voltage in which the second mains voltage terminal 20 is positive relative to the first mains voltage terminal 18 data communication is possible from the first data processing unit 6 to the second data processing unit 12, the first npn switching transistor 114 being conductive and the second npn switching transistor 140 being cut off, and a current flowing from the second mains voltage terminal 40 to the first mains voltage terminal 18 via the capacitor 162, the diode 146, the diode 148, the communication wire 48, the current-limiting resistor 116 and the first npn switching transistor 114. This current pulls down the voltage on the second communication terminal 46, as a result of which the pnp transistor 154 is turned on and a data signal voltage appears across the resistor 160. The current also charges the capacitor 162, the voltage across the capacitor 162 being limited by the zener diode 164. Thus, after an adequate number of data current pulses a supply voltage is available between the second reference terminal 44 and the node 142. In the other half-cycle of the mains voltage data communication is possible in the opposite direction. The diode 130 and the diode 158 protect the base-emitter junction of the associated pnp transistors against excessive reverse voltages. The diode 122 and the diode 150 isolate the components connected to the anode side from excessive reverse voltages. As a result of the current-limiting resistor 116 and the current-limiting resistor 144 the associated first npn switching transistor 114 and second npn switching transistor 140 will behave as a current sources, which has the advantage already discussed with reference to FIG. 3, that the instantaneous voltage on the communication wire 48 resulting from capacitive cross-talk between the three wires has no influence or reduces the influence on the data signal transfer. If this does not present a problem, it will be adequate to use one series resistor without a parallel-connected diode, which series resistor may be arranged at an arbitrary end of the communication wire 48.

By way of example the circuit arrangements shown herein use bipolar transistors whose control electrode, first main electrode and second main electrode correspond to the base, the emitter and the collector, respectively. However, the relevant circuit arrangements may also employ unipolar transistors, in which case the control electrode, first main electrode and second main electrode correspond to the gate, the source and the drain, respectively.

We claim:

1. A vacuum cleaner comprising: a first functional unit (2) for providing suction power, and a second functional unit (10) for vacuuming by using the suction power and for coupling electrically to the first functional unit (2);

which first functional unit (2) comprises a first mains voltage terminal (18) and a second mains voltage terminal (20) for receiving an alternating mains voltage, and a first data processing unit (6) having a first reference terminal (26) and a first communication terminal (28);

which second functional unit (10) comprises a first mains voltage terminal (36) and a second mains voltage terminal (40) for receiving the alternating mains voltage, and a second data processing unit (12) having a second reference terminal (44) and a second communication terminal (46);

which first mains voltage terminal (18) of the first functional unit (2) is coupled to the first mains terminal (36) of the second functional unit (10) via a first mains voltage wire (38) and a first mains voltage contact (32);

which second mains voltage terminal (20) of the first functional unit (2) is coupled to the second mains voltage terminal (40) of the second functional unit (10) via a second mains voltage wire (42) and a second mains voltage contact (34); and which first communication terminal (28) is coupled to the second communication terminal (46) via a communication wire (48) and a communication contact (30) wherein the first reference terminal (26) is connected to the first mains voltage terminal (18) of the first functional unit (2) and the second reference terminal (44) is connected to the second mains voltage terminal (40) of the second functional unit (10).

2. A vacuum cleaner as claimed in claim 1, wherein the first data processing unit (2) comprises a current source (56, 66) for supplying to the first communication terminal (28) a signal current whose value varies in response to a data signal to be transmitted via the communication wire (48), and the second data processing unit (12) comprises a current-voltage converter (58, 76) for converting the signal current into a signal voltage, and a level detector (60) for comparing the signal voltage with a reference voltage (62).

3. A vacuum cleaner as claimed in claim 2, wherein the current source (56, 66) comprises: a first transistor (66) having a control electrode connected to receive the data signal, a first main electrode coupled to the first reference terminal (26) via a first resistor (68), and a second main electrode coupled to the first communication terminal (28).

4. A vacuum cleaner as claimed in claim 3 wherein the level detector 60) comprises: a second transistor (80) having a control electrode coupled to the second reference terminal (44), a first main electrode, and a second main electrode coupled to a supply voltage source (86) via a second resistor (84), and wherein the current-voltage converter (58) comprises a third resistor (76) connected between the first main electrode of the second transistor (80) and the second reference terminal (44).

5. A vacuum cleaner as claimed in claim 3 wherein the first communication terminal (28) is coupled to the current source (56, 66) via a first diode (102) and the second communication terminal (46) is coupled to a current-voltage converter (58, 76) via a second diode (108), the forward direction of the first diode (102) and the second diode (108) corresponding to the direction of the signal current from the current source (56, 66).

6. A vacuum cleaner as claimed in claim 2 wherein the level detector (60) comprises: a second transistor (80) having a first main electrode coupled to the second reference terminal (44) and a second main electrode coupled to a supply voltage source (86) via a second resistor (84), and wherein the current-voltage converter (58) comprises a third resistor (76) connected between the first main electrode of the second transistor (80) and the second reference terminal (44).

7. A vacuum cleaner as claimed in claim 6 wherein the first communication terminal (28) is coupled to the current source (56, 66) via a first diode (102) and the second communication terminal (46) is coupled to a current-voltage converter (58, 76) via a second diode (108), the forward direction of the first diode (102) and the second diode (108) corresponding to the direction of the signal current from the current source (56, 66).

8. A vacuum cleaner as claimed in claim 2, wherein the first communication terminal (28) is coupled to the current source (56, 66) via a first diode (102) and the second communication terminal (46) is coupled to the current-voltage converter (58, 76) via a second diode (108), the forward direction of the first diode (102) and the second diode (108) corresponding to the direction of the signal current from the current source (56, 66).

9. A vacuum cleaner as claimed in claim 1, wherein the first data processing unit (6) comprises: a switch connected between the first communication terminal (28) and the first reference terminal (26), to supply to the first communication terminal (28) a first signal current whose value varies as a result of the switch being turned on and off in response to a first data signal to be transmitted via the communication wire (48), wherein the second data processing unit (12) comprises: a capacitor (162) connected between the second reference terminal (44) and a node (142), and a first diode which is conductive for the first signal current and which is connected between the node (142) and the second communication terminal (46), and wherein a current-limiting resistor (116) is included in the current path defined by the first communication terminal (28) and the second communication terminal (46).

10. A vacuum cleaner as claimed in claim 9, wherein the switch of the first data processing unit (6) comprises: a first transistor (114) of a first conductivity type, having a control electrode connected to receive the data signal, a first main electrode coupled to the first reference terminal (26), and a second main electrode coupled to the first communication terminal (28) and wherein the second data processing unit (12) comprises: a second transistor (154) of a conductivity type opposite to the first conductivity type, having a first main electrode connected to the second reference terminal (44), a second main electrode coupled to the node (142) via a first resistor (160), and a control electrode coupled to the second reference terminal (46) via a second resistor (156) and to the second communication terminal (46) via a third resistor (152).

11. A vacuum cleaner as claimed in claim 10, wherein the second data processing unit (12) further comprises a third transistor (140) of the first conductivity type, having a control electrode connected to receive a second data signal, a first main electrode connected to the node (142), and a second main electrode connected to the second communication terminal (46) to supply a second signal current, and in that the first data processing unit (6) comprises a second diode (118) arranged in parallel with the first transistor (114) and conducting for the second signal current.

12. A vacuum cleaner as claimed in claim 11, wherein the limiting resistor is made up of two sub-resistors (116, 144), one of the sub-resistors being arranged in series with the first communication terminal (28) and being shunted by a third diode (120) which conducts for the second signal current and the other sub-resistor (144) being arranged in series with the second communication terminal (46) and being shunted by a fourth diode (148) which conducts for the first signal current.

* * * * *